US009545553B2

(12) United States Patent
de Zordo et al.

(10) Patent No.: US 9,545,553 B2
(45) Date of Patent: Jan. 17, 2017

(54) PROJECTILE LAUNCHING DEVICE

(75) Inventors: Stephen Patrick de Zordo, Oakland, CA (US); Scott Shanks, San Francisco, CA (US)

(73) Assignee: InPlay Products, Inc., San Francisco, CA (US)

( * ) Notice: Subject to any disclaimer, the term of this patent is extended or adjusted under 35 U.S.C. 154(b) by 570 days.

(21) Appl. No.: 13/355,434

(22) Filed: Jan. 20, 2012

(65) Prior Publication Data

US 2012/0252611 A1 Oct. 4, 2012

Related U.S. Application Data

(60) Provisional application No. 61/434,746, filed on Jan. 20, 2011.

(51) Int. Cl.

| | |
|---|---|
| ***A63B 67/06*** | (2006.01) |
| ***F42B 6/00*** | (2006.01) |
| ***F41B 15/00*** | (2006.01) |

(52) U.S. Cl.

CPC ..... *A63B 67/06* (2013.01); *A63B 59/30* (2015.10); *F41B 15/00* (2013.01); *F42B 6/00* (2013.01); *A63B 2225/01* (2013.01)

(58) Field of Classification Search

CPC ... A63B 67/00; A63B 67/06; A63B 2067/063; A63B 71/02; A63B 2225/01; A63B 59/30; F41B 15/00; F42B 6/00

USPC ..... 473/588, 589; 273/317, 317.1

See application file for complete search history.

(56) References Cited

U.S. PATENT DOCUMENTS

| | | | | |
|---|---|---|---|---|
| 429,531 | A * | 6/1890 | De Martino | 473/589 |
| 931,221 | A | 8/1909 | Rogers et al. | |
| 2,050,914 | A * | 8/1936 | Anderson | 273/401 |
| 2,080,489 | A * | 5/1937 | Knorpp | 473/589 |
| 2,371,567 | A * | 3/1945 | Wilson | 473/514 |
| 2,634,982 | A * | 4/1953 | Gaede | 473/588 |
| 2,679,711 | A * | 6/1954 | Learnard | 446/27 |
| 2,690,339 | A | 9/1954 | Hall | |
| 2,953,378 | A | 9/1960 | La Veigne, Jr. | |
| 3,026,110 | A * | 3/1962 | Hess et al. | 473/570 |
| 3,082,572 | A | 3/1963 | Knox et al. | |
| 3,672,675 | A | 6/1972 | Morris, Jr. | |
| 3,764,141 | A | 10/1973 | Robertson et al. | |
| 3,823,942 | A * | 7/1974 | Duncan | 473/514 |
| 3,895,801 | A * | 7/1975 | Baird | 273/350 |
| 3,976,297 | A * | 8/1976 | Seymour | 273/335 |
| 4,014,545 | A | 3/1977 | Keim | |
| 4,174,834 | A * | 11/1979 | De Martino | 473/514 |
| 4,204,682 | A * | 5/1980 | Brown | 273/401 |
| 4,209,936 | A * | 7/1980 | Sklar | 446/46 |

(Continued)

*Primary Examiner* — Raleigh W Chiu

(74) *Attorney, Agent, or Firm* — Law Offices of Betsy Miller; S. Elizabeth Miller, Esq.

(57) ABSTRACT

A sports and games apparatus consisting of two rods and an aerodynamic projectile with an opening which receives the two rods. The projectile is launched by manipulating the rods in an opposing fashion. The opening of the projectile is of the appropriate size to allow for the rods to slide through, but not large enough that the projectile exhibits unwanted motions that inhibit accuracy during the launching motion. The rods are used to propel the projectile towards a variety of targets which interact with the projectile in various ways. The projectile may comprise a multitude of aerodynamic shapes and a multitude of methods for interacting with targets.

8 Claims, 6 Drawing Sheets

(56) References Cited

U.S. PATENT DOCUMENTS

| | | | | | |
|---|---|---|---|---|---|
| 4,236,716 | A | | 12/1980 | Douglas, Jr. | |
| 4,246,720 | A | * | 1/1981 | Stone | 446/47 |
| 4,307,535 | A | | 12/1981 | Martin | |
| 4,531,745 | A | * | 7/1985 | Leidy | 273/336 |
| 4,819,947 | A | | 4/1989 | MacKey | |
| 5,362,067 | A | * | 11/1994 | Nelson | 473/589 |
| 5,421,584 | A | * | 6/1995 | Planinc et al. | 473/514 |
| 5,438,972 | A | * | 8/1995 | Harbin | 124/27 |
| 5,454,566 | A | | 10/1995 | Koenig | |
| 5,613,684 | A | | 3/1997 | Gittens et al. | |
| 6,062,997 | A | | 5/2000 | Seymour | |
| 6,135,455 | A | * | 10/2000 | McNally | 273/338 |
| 7,275,747 | B1 | | 10/2007 | Tanita | |
| 7,338,047 | B2 | * | 3/2008 | Kelley et al. | 273/317 |
| 7,607,665 | B2 | | 10/2009 | Jordan | |
| 7,631,876 | B1 | | 12/2009 | Walterscheid | |
| 7,740,246 | B1 | | 6/2010 | Walterscheid | |
| 2012/0252611 | A1 | * | 10/2012 | Dezordo et al. | 473/589 |

* cited by examiner

Fig. 2
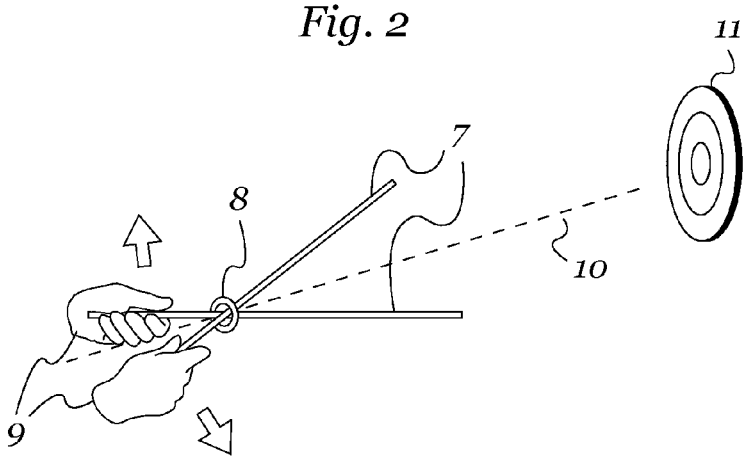
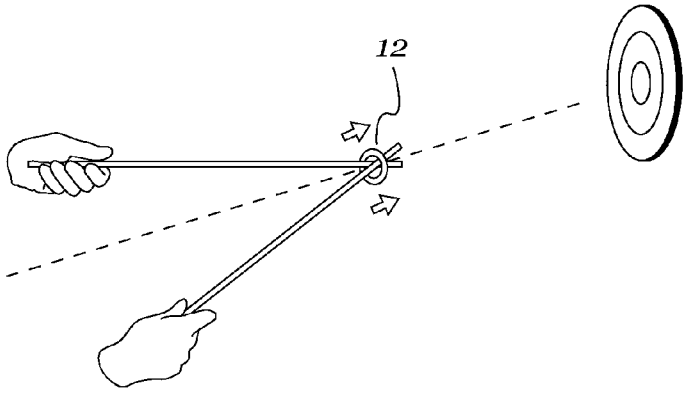
Fig. 2a
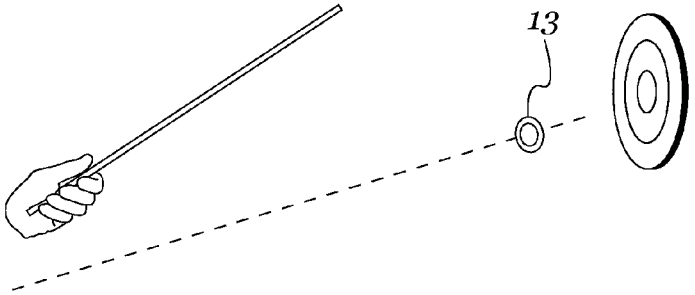
Fig. 2b
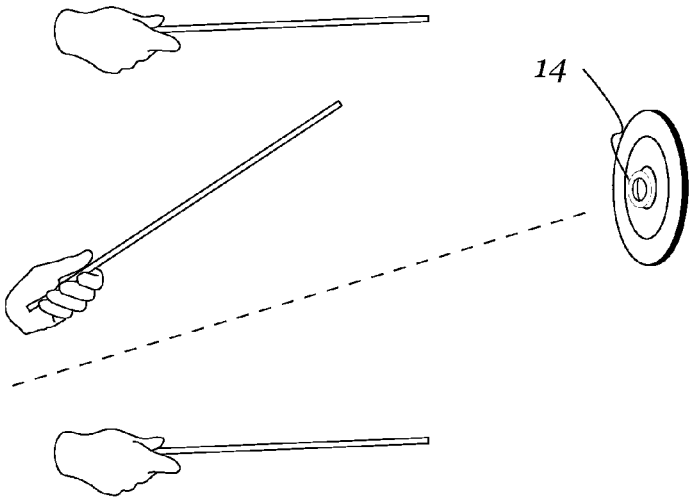
Fig. 2c

Fig. 3
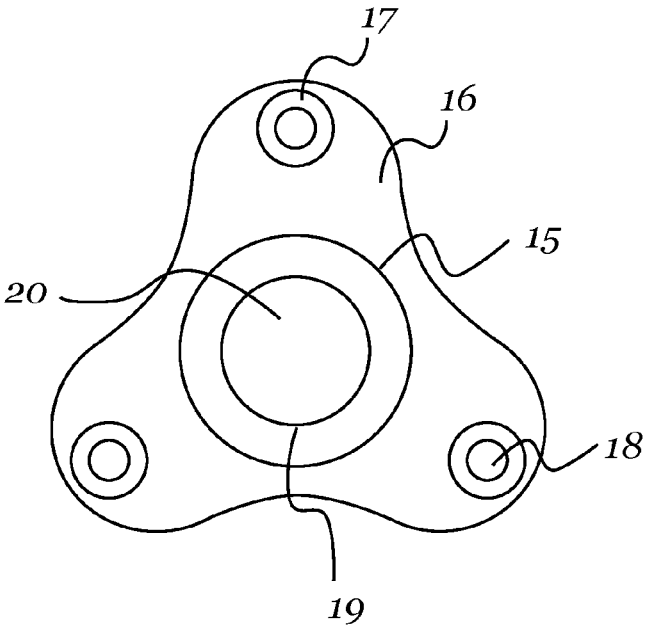
Fig. 3b
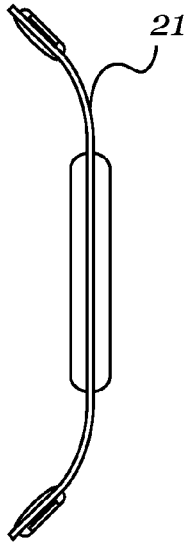
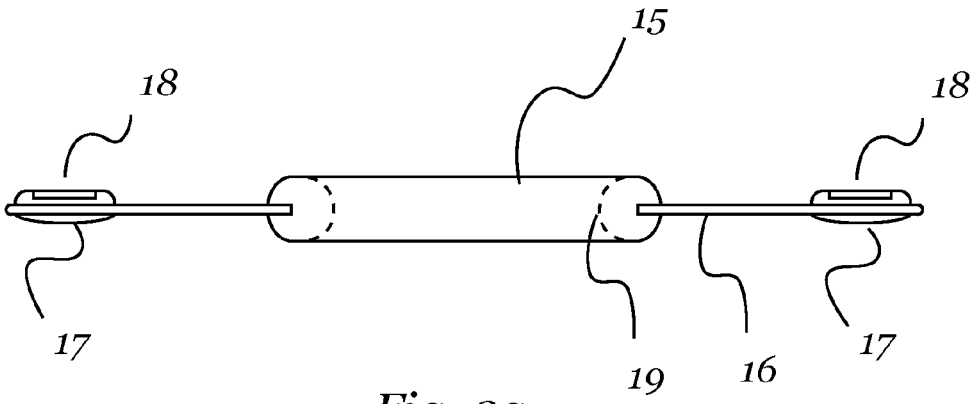
Fig. 3a

PROJECTILE LAUNCHING DEVICE

This application claims benefit to U.S. provisional application Ser. No. 61/434,746 filed Jan. 20, 2011, the disclosure of which is incorporated in its entirety by reference herein.

FIELD OF INVENTION

Handheld launchers and projectiles for target games.

BACKGROUND OF INVENTION

The present invention generally relates to games where players manipulate two sticks or rods to propel a ring to another person who catches the ring with another stick or set of rods. An early American game "Game of Graces" exhibits the tossing of a ring with two sticks for the intent of catching the ring by another player with another set of sticks. Games using sticks to propel objects are known as disclosed in U.S. Pat. Nos. 4,174,834 and 429,531. While these inventions enable users to catch and release ring or disc shaped projectiles, their design and functionality are not suitable for the accuracy required of target based games due to the size of the opening required to achieve both catching and tossing with the same apparatus. The large opening allows for unwanted movement of the projectile during the launching method that inhibits accuracy and reduces the force and momentum imparted to the projectile by the rods, whereas a smaller opening that tightly constrains the opening of the projectile to the intersection of the sticks provides the accuracy necessary for target based games.

SUMMARY OF THE INVENTION

An object of the invention is to provide a manual apparatus utilizing a projectile comprised of resilient material with an opening for receiving two rods and a method of propelling the projectile by manipulating the rods in an opposing fashion while engaged within the opening of the projectile, thus propelling the projectile towards a target or game board with sufficient accuracy to hit desired sections of the board.

The primary innovation of the invention is the introduction of a smaller opening than used in similar games using two rods to propel an annular ring, such as the traditional colonial American game "Game of Graces" in which an annular ring is tossed and caught between two players using two rods to launch the ring and catch the ring by engaging one or both rods through the ring's opening while in flight. By introducing a smaller opening for the rods to engage, the opening of the projectile is tightly constrained to the intersection of the rods during the launching method, removing unwanted movement of the projectile away from the intended trajectory path. The tight constraint of the projectile to the intersection of the rods allows for the accuracy required for target based skill games. The optimal specification for the diameter of the opening of the projectile or annual ring is approximately 2.2 times the diameter of one of the rods. This ratio allows the ring to easily slide along the rods as the intersection of the rods as moves away from the shooter, yet prevents unwanted movement of the projectile away from the intended trajectory path. At approximately 10 times the diameter of one of the rods, the diameter of the opening of the projectile is rendered unsuitable for accurate targeting. A larger diameter also reduces the amount of directional force imparted to the projectile as the loose fit to the intersection of the rods can allow energy from the rods to be spent on motion by the projectile away from the intended trajectory.

Another object of the invention is that the projectile may be comprised of flight stabilizing aerodynamic appendages that orient the projectile in an optimal flight position or trajectory. The aerodynamic appendages may either stabilize the vertical flight position of the projectile as it leaves the rods during launch, or may reorient the projectile to a horizontal flight position during flight for longer distance. The aerodynamic elements can be used to enhance the flight characteristics for better targeting or for enjoyment and entertainment purposes. In its simplest form, an annular ring of the described specifications launched by a pair of rods has sufficient aerodynamic qualities to travel in the player's intended trajectory while also retaining its horizontal orientation throughout its flight, due in part to rotational momentum imparted by the rods upon the annular ring which acts as a stabilizing force on the ring. However, the ring and rods alone create significant speed and momentum that may create safety concerns for children and indoor play. The introduction of aerodynamic elements to the projectile can serve not only to stabilize the projectile in flight, but may also reduce the speed and momentum of the projectile to address safety concerns.

Another object of the invention is to provide the projectile with a method for interacting with a target so that the projectile's area of impact with the target is easily visible. The projectile can be propelled towards a target mounted vertically on a wall like traditional darts, or mounted horizontally on the ground, like lawn darts. The projectile can also be used to knock over or change the physical orientation of elements within a target, such as a set of lightweight bowling pins or a shooting gallery with targets that fall over when struck. The projectile can be adapted to best suit each of these game variations by modifying the aerodynamic properties of the projectile. Methods of temporarily attaching the projectile to a target upon impact can also be added to the projectile, such as but not limited to magnetic elements for ferrous targets or Velcro elements for fabric targets. The target may also have elements protruding from the target surface that engage the opening of the projectile.

BRIEF DESCRIPTION OF THE DRAWINGS

FIG. 2 shows the projectile and the rods and demonstrates the method for launching the projectile.

FIG. 3 is the projectile with aerodynamic elements for a vertical flight position.

DETAILED DESCRIPTION OF THE DRAWINGS

Figure 1:
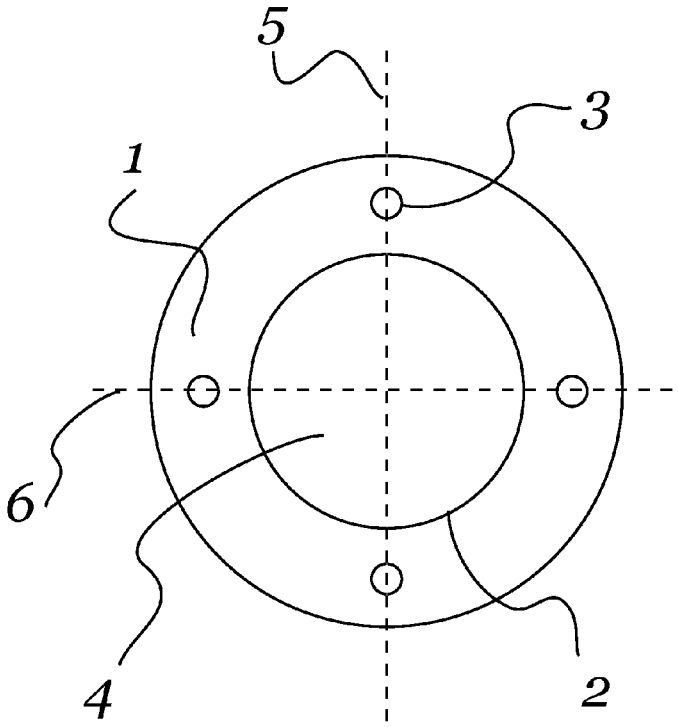
FIG. 1 is the projectile in its simplest configuration.
Figure 1A:
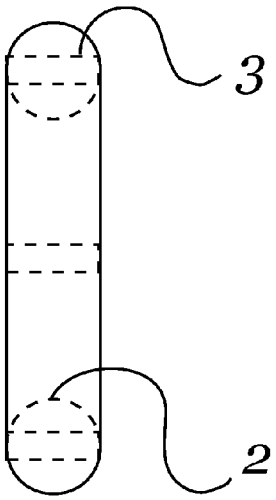

The projectile as shown in FIG. 1 and FIG. 1*a* comprises an annular ring 1 with magnets 3 embedded in the body of the ring. The ring has a smooth circumferential edge 2 around the opening 4, allowing the ring to slide easily along the rods 7 as shown in FIG. 2. This configuration is for propelling the ring in a vertical position where the both the vertical 5 and horizontal 6 axis of the ring is perpendicular to the flight trajectory 10 throughout the flight 13. Both axes are parallel with the surface of the target upon impact. The embedded magnets would then fix the ring on to a magnetically receptive target at the area of impact 14.

FIG. 2-FIG. 2*c* shows the method for propelling the projectile 8 with the rods 7. The motion begins by inserting the rods 7 through the opening of the projectile 4. Then, while holding one rod in each hand 9, rods are crossed at an angle of approximately 90-45 degrees with one stick on top of the other so that the intersection of the sticks is located inside the opening of the projectile 8. The hands are then moved apart in opposite directions. The intersection of the sticks at the beginning of the motion 8 is closer to where the hands are holding the rods. As the hands are moved apart, the intersection of the sticks moves away from the hands and the projectile, being constrained to the intersection of the sticks, is propelled forward until the sticks no longer intersect at which point the projectile is released in flight 13. Optimum accuracy is obtained by the bilaterally symmetrical opposing outward motion of both hands holding the rods so that the location of the intersection of the rods at the beginning of the motion 8 and the location at which the rods separate 12 are located on a line in space that intersects with the intended target area 14. The projectile remains removably attached to the target at the area of impact by a method such as, but not limited to, magnetic attraction.

The projectile as shown in FIG. 3-FIG. 3*b* is an example of a projectile with aerodynamic elements that reduce the speed of the projectile and stabilize the projectile in a vertical flight position. The projectile comprises an annular ring 15 with an opening 20 having circumferential edges 19 with aerodynamic appendages 16 projecting radially from the outer edge of the ring. Each appendage is radially symmetrical and is comprised of a semi-rigid material that allows for bending 21 with air flow during flight. Each appendage has a resilient housing 17 for a magnet 18 which attaches the magnet to the semi-rigid material 16. During flight, the appendages create drag to slow the projectile to safer speeds by bending with the airflow 21 and imparting drag forces behind the projectile's center of gravity while also stabilizing the projectile's flight position by imparting equal aerodynamic drag forces around the radius of the ring.

Figure 4:
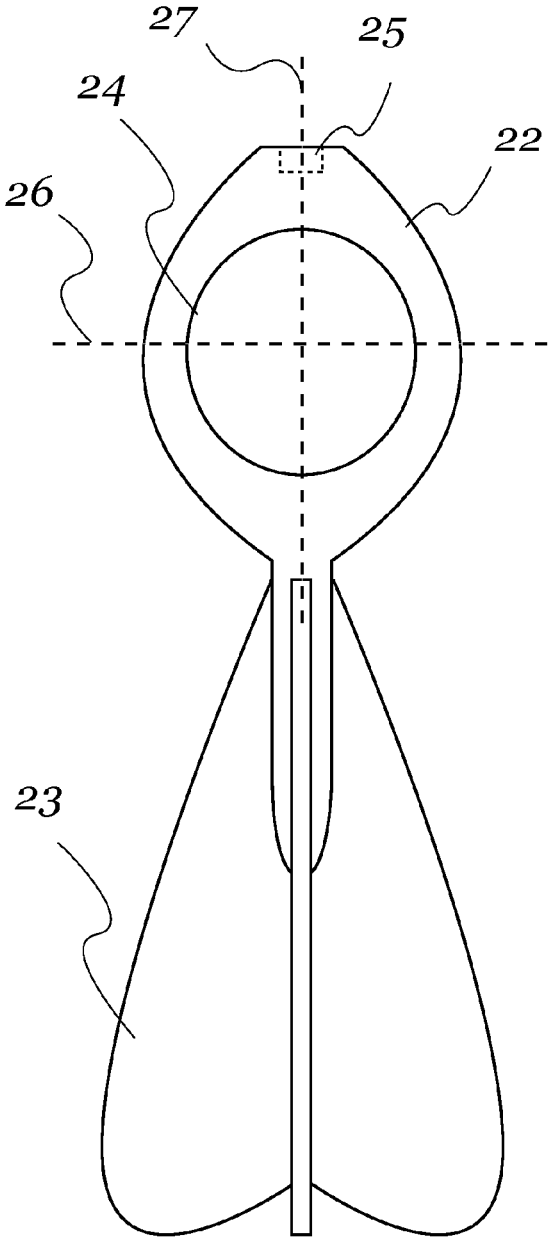
FIG. 4 is the projectile with aerodynamic elements for a horizontal flight position.
Figure 4A:
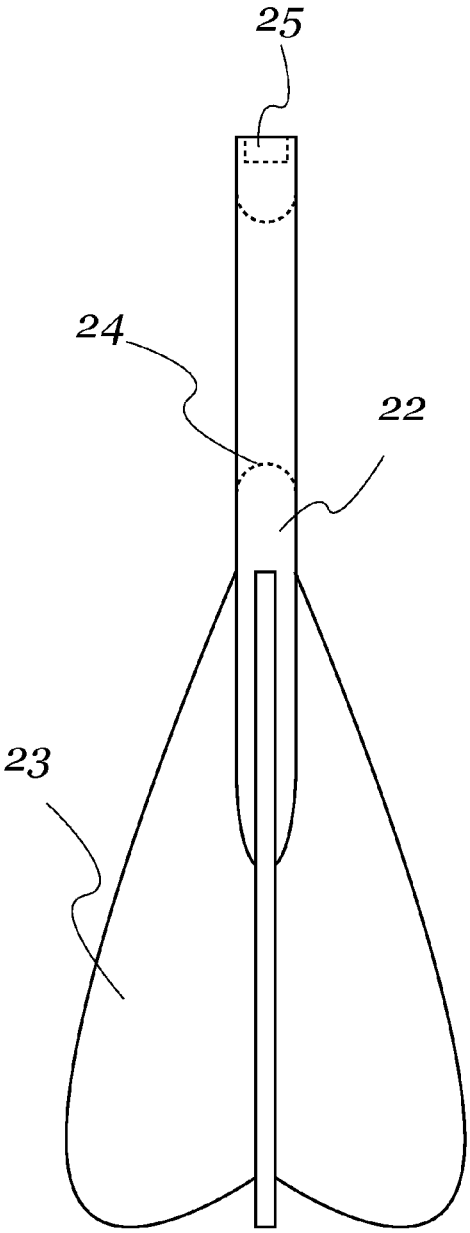
Figure 5:
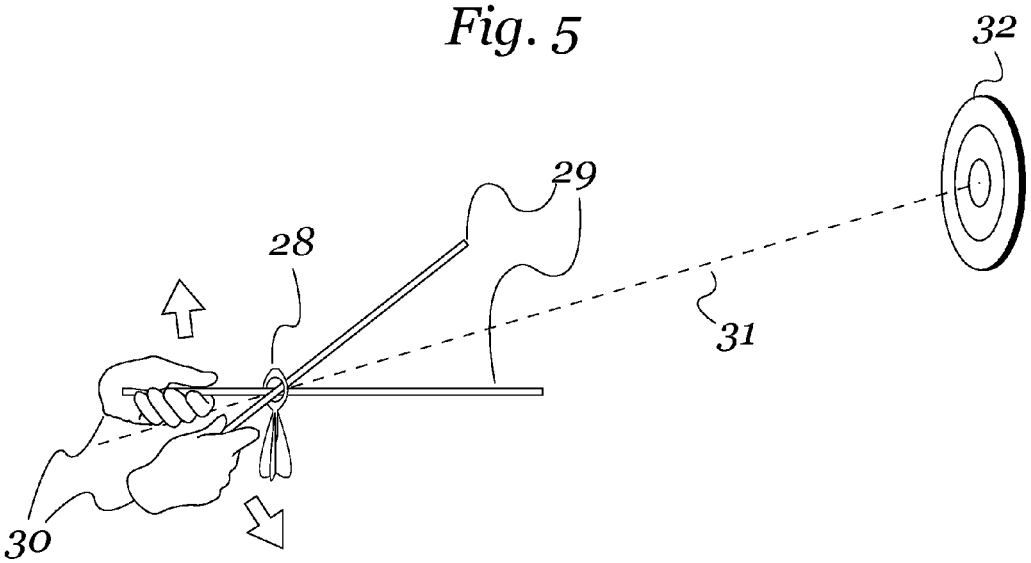
FIG. 5 shows the launching of a projectile with aerodynamic elements for a horizontal flight position.
Figure 5A:
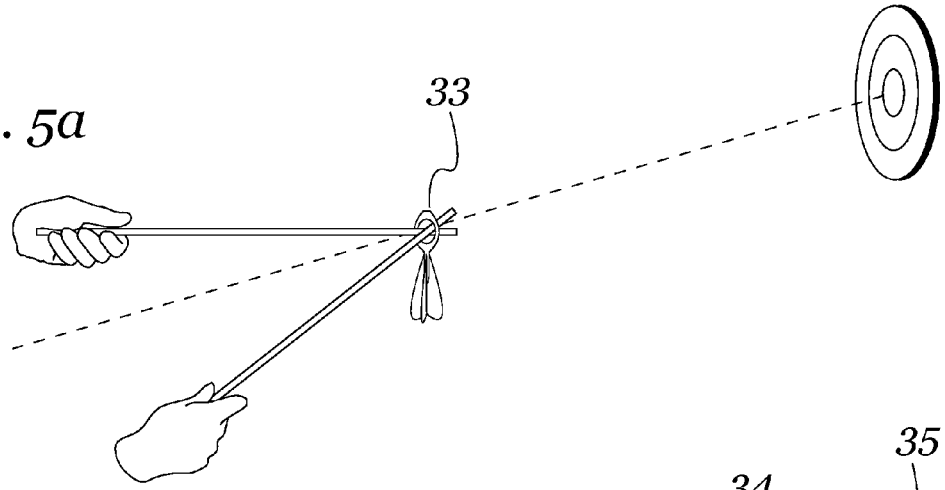
Figure 5B:
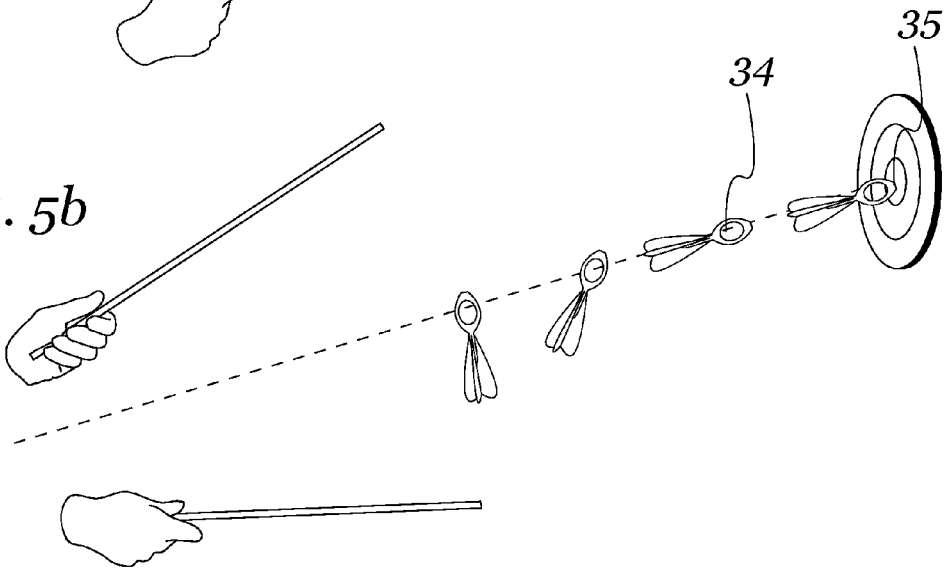

The projectile as shown in FIG. 4 and FIG. 4*a* is an example of a projectile with aerodynamic elements that change the flight position from vertical to horizontal after being released from the rods as shown in FIG. 5. The projectile is comprised of a resilient body 22 with an opening with smooth circumferential edges 24, an aerodynamic element, similar to the flights of a traditional dart 23, attached to the outer edge of the projectile, and a magnet 25 embedded on the outer edge of the ring opposite the aerodynamic element 23. At the beginning of the motion to propel the projectile with the rods 28, the projectile is in a vertical position, with its vertical axis 27 perpendicular to the intended flight trajectory 31. As the hands 30 holding the rods 29 are moved in opposite directions and the projectile slides away from the hands, the projectile remains approximately in a vertical position 33. After being released from the rods, the aerodynamic element creates drag which rotates the projectile on its horizontal axis 26 until the vertical axis is parallel with the flight trajectory 34. This creates a slimmer aerodynamic profile as it travels in flight, allowing for greater distances than the projectile in FIG. 3. This also aligns the magnet 25 (or other method of attaching to the target) at the leading edge of the projectile to impact the target in the correct position 35.

Figure 6:
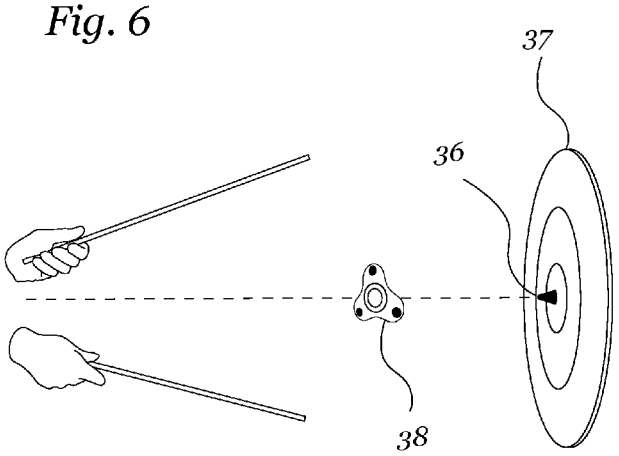
FIG. 6 shows various targets that can be used to judge the accuracy of the projectile's trajectory.
Figure 6A:
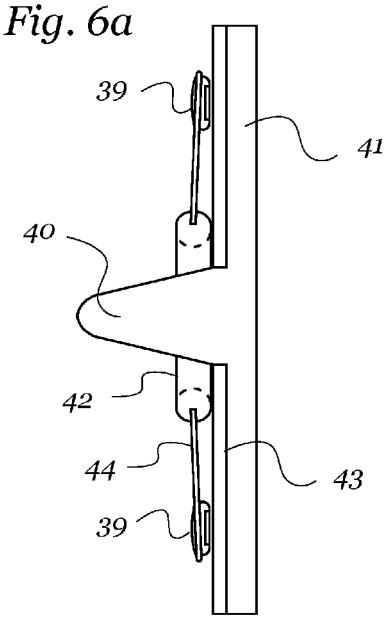
Figure 6B:
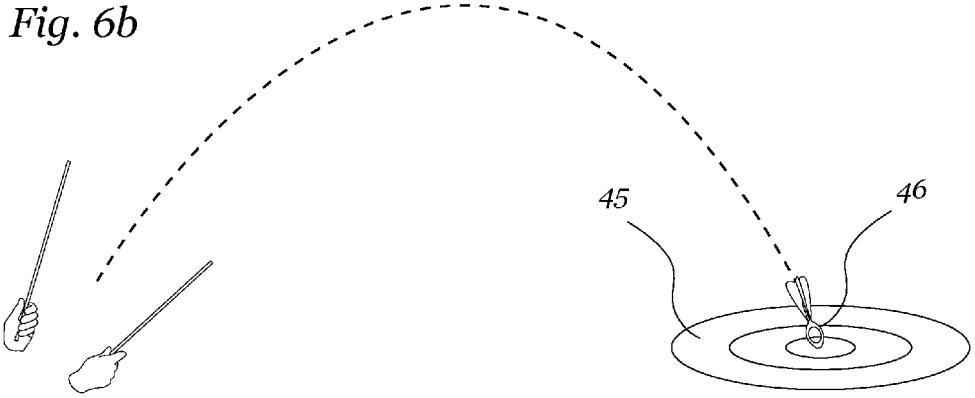
Figure 6C:
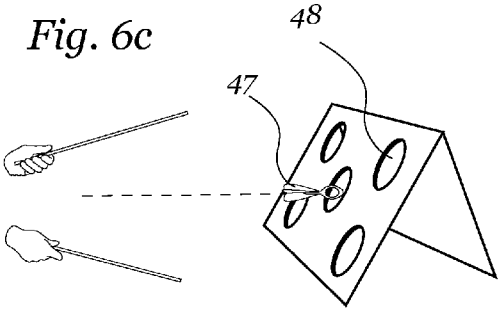
Figure 6D:
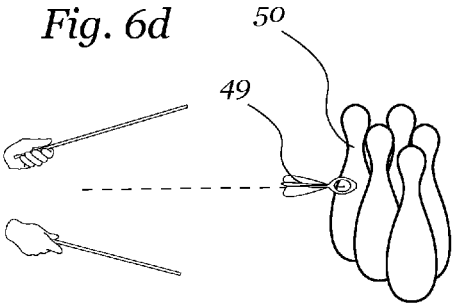

FIGS. 6-6*d* demonstrate various methods the projectile can interact with targets. FIG. 6 demonstrates a flat surface target 37 mounted vertically like a traditional dartboard. The projectile as described in FIG. 3 is propelled towards the target in a vertical flight position 38. Upon impact with the target FIG. 6*a*, the aerodynamic appendages 44 with attached magnets 39 attract to a ferrous layer 43 which is bonded with the target substrate 41. The described target is also comprised of a protruding element 40 that can engage with the opening of the projectile 42. The player's accuracy can be determined by the different areas drawn on the surface of the target 37, or by engaging the projectile's opening 42 with the target's protrusion 40. FIG. 6*b* demonstrates a target laid in a horizontal position 45, where the player must follow an arcing trajectory with the projectile 46 to engage the target. FIG. 6*c* demonstrates a target with openings 48 that the projectile 47 can enter or pass through. FIG. 6*d* demonstrates a target 50 where the projectile 49 alters the physical orientation of objects, in this case a set of lightweight pins that are knocked over upon impact.

What is claimed is:

1. An apparatus comprising:

a. a plurality of rods having a first end and second end, and said rods having equal diameter at the first end and having a diameter suitable for grasping with one hand at the second end;

b. a projectile having an opening, wherein the diameter of said opening is sufficient to allow for the first ends of said rods to pass through said opening simultaneously, and said opening allows for said rods to slidably travel through said opening, and said opening having a circumferential edge, and said projectile having an aerodynamic body, and wherein said aerodynamic body comprises three or more appendages, and each of said three or more appendage houses a magnet, and wherein said aerodynamic body is comprises of a semi-rigid material, and said semi-rigid material bends during the flight such that said magnets housed in each of said three appendages affix to a target; and c. said target, wherein said target is a vertical target comprising a means for the projectile to remain attached to said target at the area of impact of said projectile to said target.

2. The apparatus of claim 1, wherein the target comprises an object or plurality of objects wherein the projectile in claim 1 alters the physical orientation of said object or objects upon impact.

3. The apparatus of claim 1, wherein the target comprises a surface, and an element protruding from said surface, and said element having a smaller diameter that the opening of the projectile in claim 1, and said element having a length longer than the depth of the opening of the projectile in claim 1.

4. An apparatus comprising:

a. a plurality of rods having a first end and second end, and said rods having equal diameter at the first end and having a diameter suitable for grasping with one hand at the second end;

b. a projectile comprising an annular ring wherein the diameter of said annular ring is sufficient to allow for the first ends of said rods to pass through said opening simultaneously, and said opening allows for said rods to slidably travel through said opening, and the diameter of said opening is smaller than ten times the diameter of the first end of one of said rods, c. three or more aerodynamic elements attached to said annular ring, wherein said three or more aerodynamic elements are comprises of a semi-rigid material, and said three or more aerodynamic elements stabilize and slow said annular ring during flight, such that said annular ring retains a substantially vertical position during the flight path and is substantially planar to a vertical target and in position to affix to said target, and wherein each of said three or more aerodynamic elements houses a means for affixing to a target.

5. The apparatus of claim 4, wherein said target comprises a means for the projectile in claim 4 to remain attached to said target at the area of impact of said projectile to said target.

6. The apparatus of claim 4, wherein said target comprises an object or plurality of objects wherein the projectile in claim 4 alters the physical orientation of said object or objects upon impact.

7. The apparatus of claim 4, wherein said target comprising a surface and an element protruding from said surface, and said element having a smaller diameter that the opening of the projectile in claim 4, and said element having a length longer than the depth of the opening of the projectile in claim 4.

8. The apparatus of claim 4, wherein the means for affixing to a target is a magnet.

* * * * *